US006360825B1

(12) United States Patent
Padgett et al.

(10) Patent No.: US 6,360,825 B1
(45) Date of Patent: Mar. 26, 2002

(54) AUTOMATIC FIRE EXTINGUISHER SYSTEM FOR USE ON COOKSTOVES AND RANGES

(76) Inventors: Randall Padgett, 2531 E. 6th St., Panama, FL (US) 32401; J. Michael Pons, 2404 Cochran Rd., Panama City Beach, FL (US) 32408

( * ) Notice: Subject to any disclaimer, the term of this patent is extended or adjusted under 35 U.S.C. 154(b) by 0 days.

(21) Appl. No.: 09/634,274

(22) Filed: Aug. 8, 2000

(51) Int. Cl.[7] ..... A62C 3/00

(52) U.S. Cl. ..... 169/65; 169/60; 169/42; 169/68; 169/29; 169/56

(58) Field of Search ..... 169/65, 60, 42, 169/59, 67, 68, 29, 54, 56, 57, 26, DIG. 1

(56) References Cited

U.S. PATENT DOCUMENTS

| | | | | | |
|---|---|---|---|---|---|
| 3,773,111 | A | * | 11/1973 | Dunn | 196/26 |
| 4,256,181 | A | | 3/1981 | Searcy | 169/65 |
| 4,418,869 | A | * | 12/1983 | Healy | 239/317 |
| 4,813,487 | A | * | 3/1989 | Mikulec et al. | 169/65 |
| 4,834,188 | A | * | 5/1989 | Silverman | 169/65 |
| 4,979,572 | A | * | 12/1990 | Mikulec | 169/65 |
| 5,297,636 | A | | 3/1994 | North | 169/65 |
| 5,899,278 | A | | 5/1999 | Mikulec | 169/65 |
| 5,984,016 | A | * | 11/1999 | Samuelsson | 169/62 |
| 5,992,531 | A | | 11/1999 | Mikulec | 169/33 |
| 6,029,751 | A | * | 2/2000 | Ford et al. | 169/60 |
| 6,102,127 | A | * | 8/2000 | Pierce | 169/37 |

* cited by examiner

*Primary Examiner*—Lesley D. Morris
*Assistant Examiner*—Dinh Q. Nguyen
(74) *Attorney, Agent, or Firm*—Carnes Cona & Dixon

(57) ABSTRACT

The present invention is an automatic fire extinguisher that is ideally suited for use with electric or gas stoves. The automatic fire extinguishing device is designed and configured to be removably secured to any sized commercial or residential range hood so as to offer protection by having a device that will automatically extinguish a fire safely, quickly and efficiently. The structure and design of the fire extinguisher is such that it is installed easily and will be nonobtrusive and still provide for an aesthetically pleasing hood while offering protection to the consumer. The system of the present invention comprises a hollow housing that maintains a dispersing media for extinguishing a fire. A mechanical movement device is located within the housing. The mechanical movement device is in contact with the housed media. In use, once a fire is detected, this mechanical movement device will force the housed media to the outlet and innately provide a device that can utilize any media for extinguishing a fire. This will ultimately provide a fire extinguisher that does not require servicing during its shelf life and will have a shelf life that is dependent upon the housed media.

19 Claims, 10 Drawing Sheets

AUTOMATIC FIRE EXTINGUISHER SYSTEM FOR USE ON COOKSTOVES AND RANGES

BACKGROUND OF THE INVENTION

1. Field of the Invention

The present invention relates generally to a self-contained fire extinguisher and more particularly to a self contained fire extinguisher for use with any residential or commercial range hood having a structure and design that incorporates any commercially available housed dispersing media so that the unit does not require servicing during its shelf life and will be operational and functional regardless of the age of the particular fire extinguisher.

2. Description of the Prior Art

The use of automatically activated fire extinguishing devices is well noted in the prior art. In the event of a cooking fire such devices release a compound onto the stove surface thereby extinguishing the fire. Typically, these automatic fire-extinguishing devices are contained in the range hood of the stove exposing unsightly and bulky cable, which accumulate grease over a period of time. Additionally, such devices have been found to be unreliable, falsely activating upon sensing heat without fire. Many of these devices also require on-site installation time, as well as complex automatic shut-off of electricity or gas to the stove requiring an electrician installation, thereby adding to the stove's expense. Yet another disadvantage to the prior art devices includes an unsightly trigger mechanism that must be positioned for sensing heat from the stove.

An example of a prior art device is disclosed in U.S. Pat. No. 4,256,181 issued to Searcy. This device is a pressured fire-extinguishing vessel located in a remote station with lines to feed the range hood. This device houses a pyrotechnic sensor means that when ignited by flames transfers the fire to a fusible link. Once the fusible link is severed, a valve on the fire extinguisher is opened causing the fire extinguishing material to discharge in the location of the pyrotechnic sensor.

Another automatic fire extinguishing device is disclosed in U.S. Pat. No. 5,297,636 issued to North. This device also features a pressurized fire-extinguishing vessel. In this patent there is disclosed a residential fire extinguishing system comprising a delayed remote fire extinguisher mounted in a cabinet over the range connected by flexible hoses to a pair of nozzles housed in the hood. In the event the fire extinguisher is activated to release the fire suppressant, the gas supply line is pressurized thereby shutting off gas supply to the stove.

Yet another fire extinguishing device is disclosed in U.S. Pat. No. 5,899,278 issued to Mikulec. This device features a pressurized fire-extinguishing vessel. This patent provides for an automatically activated self contained remote station fire extinguishing stove device which is installed in a stove hood and features a compact design. In addition this patent also provides for an automatic stove shut-off.

Mikulec discovered the need of alternating and changing the structure of the conventional fire extinguisher, by providing a device that is not pressurized. In U.S. Pat. No. 5,992,531, Mikulec discloses a non-pressured unit that can be utilized as a conventional fire extinguisher, or in an alternative embodiment, can be utilized above the stove. In order to accomplish this type of non-pressurized configuration, Mikulec designed the interior of the unit to include a spring-loaded plunger. This will provide for the plunger to be in a compress state and allow for fluid to be stored therein. Once a fire is detected, a fusible link melts and causes the spring to be released and innately provide for the fluid to be dispensed to the appropriate location. Though efficient, this device does not effectively utilize the spring, in that the spring reaches maximum velocity prior to fully dispensing the fluid. Thus, Mikulec relies mainly on gravity for dispensing the fire retardant material. A minimal amount of pressure is used and consequently, may not be adequate for dispensing the fire retardant media affectivity. In addition, Mikulec's fusible link system is complex in nature, and thus innately provides for a system that is not as economical if the design was more compact and included fewer components. Further, Mikulec discloses an attaching means, for use with conventional hoods that utilizes brackets. Though efficient, the brackets do provide for holes to be drilled in the existing cabinets and/or hood. The prospect of drilling holes may discourage some individuals from installing the unit, and thus will defeat the intended purpose of the present invention.

Accordingly, it is seen that there is a need for an automatic fire extinguishing apparatus designed and configured to operate efficiently and one that will not require servicing during its shelf life, like conventional pressurized fire extinguishers. The device should be structured so as to provide a means of automatically extinguishing a cooking fire quickly and effectively by dispersing an extinguishing media over the source of fire. This device should be compact in size, adaptable to any size range hood and optionally be adapted to be used in either a commercial or residential environment. Ideally, this apparatus should also be designed so as to allow for ease of installation and removal, so as to innately provide for a non-pressurized fire extinguishing vessel that is self-contained within range's hood. In addition, the present invention should not be limited to use in an hood, but should also be designed to replace conventional hand-held fire extinguishers, by providing a product that forces the housed media quickly and efficient and thus provide for a non-pressurized unit.

As will be seen, the present invention achieves its intended purposes, objectives and advantages by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention is an automatic fire extinguisher that is ideally suited for use with electric or gas stoves. However, it is to be understood, by those skilled in the art, that this fire extinguisher apparatus can be used and/or attached in/to any environment/structure, so as to be adapted to extinguish flames, fires or the like when one is present. Inherently, the present invention is a fire extinguisher that can be used in combination with an electric, gas stoves and/or other applications for distinguishing fires. Thus, the present invention is a fire extinguisher that can be used in conventional form, such as a hand held unit, or optionally, can be located above a stove to provide a means of extinguishing fires.

In the preferred application, this automatic fire extinguishing device is designed and configured to be removably secured to any sized commercial or residential range hood so as to offer protection by having a means of automatically extinguishing a fire safely, quickly and efficiently. The structure and design of the fire extinguisher is such that it is installed easily and will be nonobtrusive and still provide for an aesthetically pleasing hood while offering protection to the consumer. Since the device is structured so as to be located under the hood, it is not visible or only partially visible when installed. The location of the device is such that it will operate quickly and efficiently when a fire is present. Thus, providing for a device that offers adequate fire prevention.

The system of the present invention comprises a hollow housing that maintains a dispersing media for extinguishing a fire. The hollow housing includes a first end and a second end. Located within the housing is the dispensing media. This media can be any commercially available media that can be used for dispensing a fire. Secured to the first end is a means for allowing the housed dispersing media to escape. Thus, this means is basically an outlet. Externally located on the housing is the release mechanism. This release mechanism will enable the substance to be released in the presence of fire. In one embodiment, the release mechanism is automatic, in an alternative arrangement, the release mechanism is manual, and in a further arrangement, the release mechanism can be either manual or automatic.

Optionally, interiorly located within the hollow housing is a mechanical movement device that will aid in releasing the media out of the housing. In addition, this mechanical movement device can aid in applying pressure to the media and thus allow for a pressurized release that does not require maintenance and will remain in its original condition and state, to innately provide for a product that will remain functional and operational regardless of its age and/or shelf life.

In essence, once a fire is detected the release mechanism is activated. This release mechanism can be automatic or, optionally, manual. Once activated, the housed dispensing media is able to escape the hollow housing via the outlet. The mechanical movement device provides the necessary force on the housed media to provide for the release to be pressurized.

For enhancing the final product, tubing or the like can be coupled to the outlet. This tubing is known as the dissipation assembly and is used to merely guide the housed media to the desired location for adequately extinguishing the fire.

Conventional means, such as the use of brackets, magnets, or the like, can be utilized for securing the unit to the undersurface of the hood. Optionally, a casing can be secured to the lower surface of the hood and this casing can removably receive the housing as describe above. Thus providing for the casing to act as a holding sleeve for maintaining and securing the housing to the lower surface of the hood.

Due to the unique and simple design of the free extinguisher of the present invention, servicing is accomplished easily, quickly and efficiently. Since the present invention does not use pressurize media, such as carbon dioxide as a propellant, as conventional fire extinguishers, charging or re-charging is not necessary. Once the device has been used (a fire has been extinguished), the extinguisher is replaced or if damage has not occurred with the unit then the dispersing media can be replaced. Replacement can occur by way of a cylinder (new housing) or by filling the "exit" with the desired material.

In one embodiment, since disbursement occurs by the force of the mechanical device and not the use of carbon dioxide, the present invention alleviates all problems generally associated with conventional fire extinguishers that do utilize carbon dioxide or other propellants (nitrogen). The use of a hollow housing that can be refilled will provide for the present invention to be configured in such a manner that servicing of the fire extinguisher can be almost instantaneous, expeditious and can be easily accomplished without removal of the entire unit by simply replacing or refilling the housing.

Accordingly, it is the object of the present invention to provide an automatic fire extinguishing device which will overcome the deficiencies, shortcomings, and drawbacks of the prior fire extinguishing devices and methods thereof.

A further object of the present invention is to provide for an automatic fire extinguishing device which is accomidable in both a residential or commercial cooking environment and simple in design so as to provide ease of installation and success during utilization Another object of the present invention, to be specifically enumerated herein, is to provide an automatic fire extinguisher device in accordance with the proceeding objects and which will conform to conventional forms of manufacture, be of simple construction and easy to use so as to provide a device that would be economically feasible, long lasting and relatively trouble free in operation.

Although there have been many automatic fire extinguishing devices, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWING

Similar reference numerals refer to similar parts throughout the several views of the drawings.

DESCRIPTION OF THE PREFERRED EMBODIMENT

Figure 1:
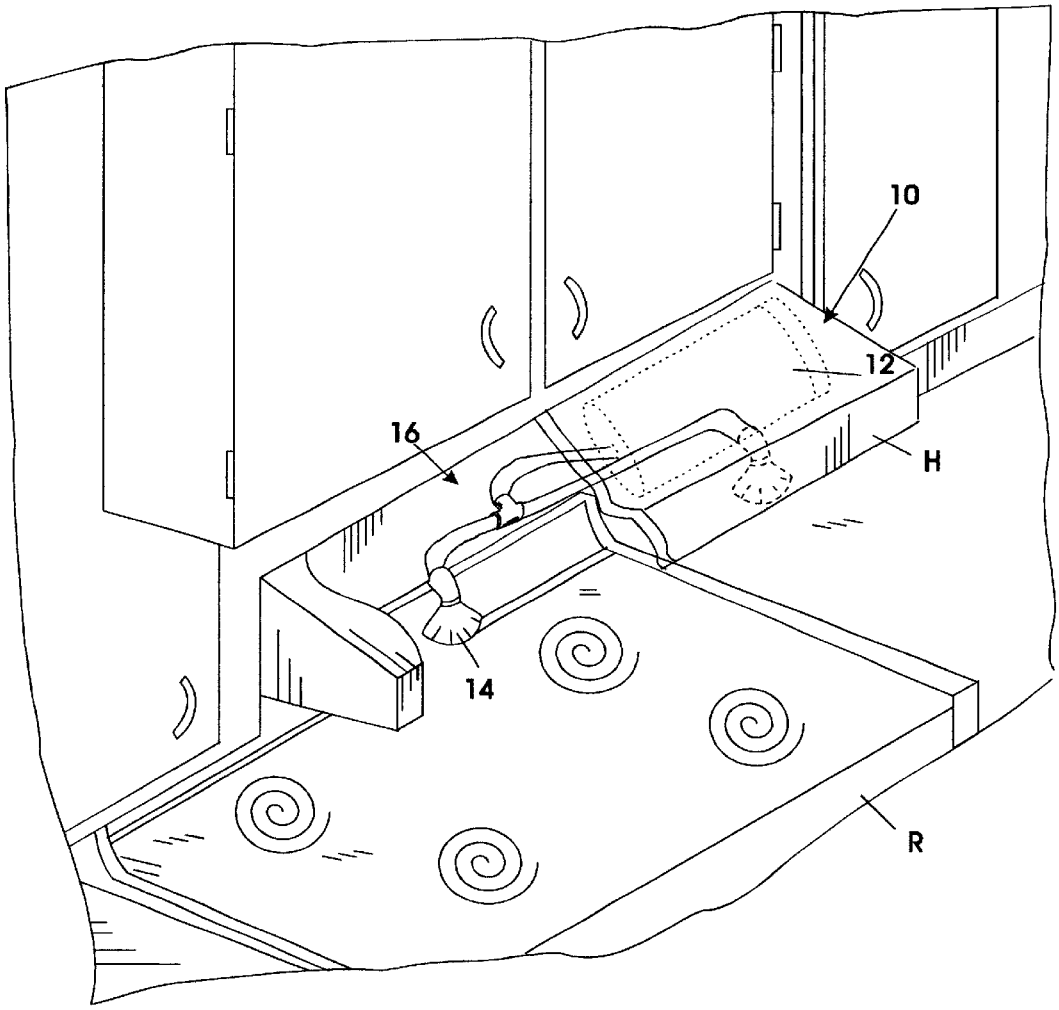
FIG. 1 is a perspective view of the fire extinguisher system of the present invention attached to conventional hood located over a range.

As seen in the drawings, in particular to FIGS. 1–8 there is shown a fire extinguisher system, denoted by reference numeral 10, that is designed and configured to dispense a media once a fire has developed on a range, stove or the like. Thus the system of the present invention will be removably secured to the undersurface of a conventional hood, so as to be accessible to the burners, yet inconspicuous, so as to be unobtrusive to the cook and/or homeowner.

The system 10 of the present invention, as seen in FIG. 1, will be attached under the hood H that is located above a conventional range R. It is noted that the attachment is shown to occur horizontally, but it is to be understood by those skilled in the art, that this system can, optionally, be attached vertically, and/or be located anywhere along the undersurface of the hood, so as to be inconspicuous, as well as functional. Being located under the hood will enable the device to activate quickly and efficiently, when a fire is detect ed on a stove, range or the like. In order to allow for such an arrangement, as seen in FIGS. 1–2*d,* the system of the present invention comprises housing 12, a release mechanism 14 and a dissipation assembly 16.

Figure 2A:
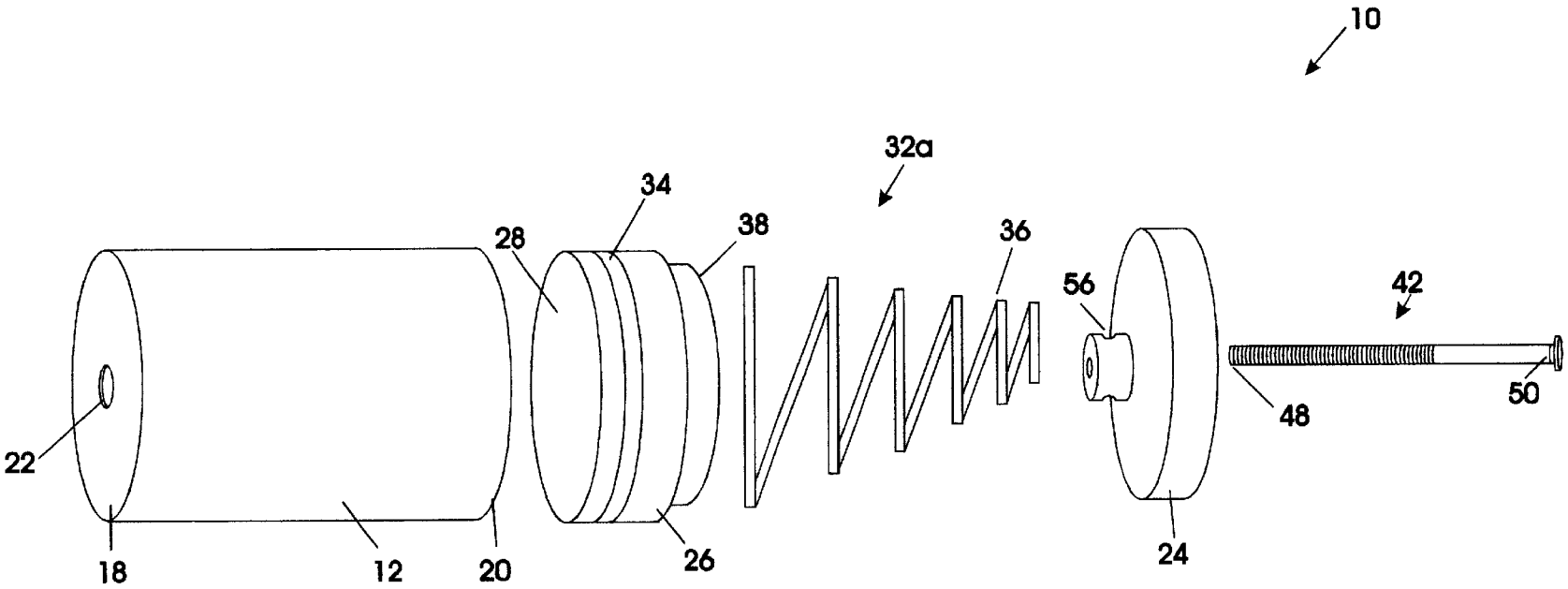
FIG. 2*a* is an exploded view of the components used in the fire extinguisher system of the present invention, illustrating the first embodiment of the mechanical movement device, including the tool that is used to place the mechanical device in a compressed and useable position.
Figure 4:
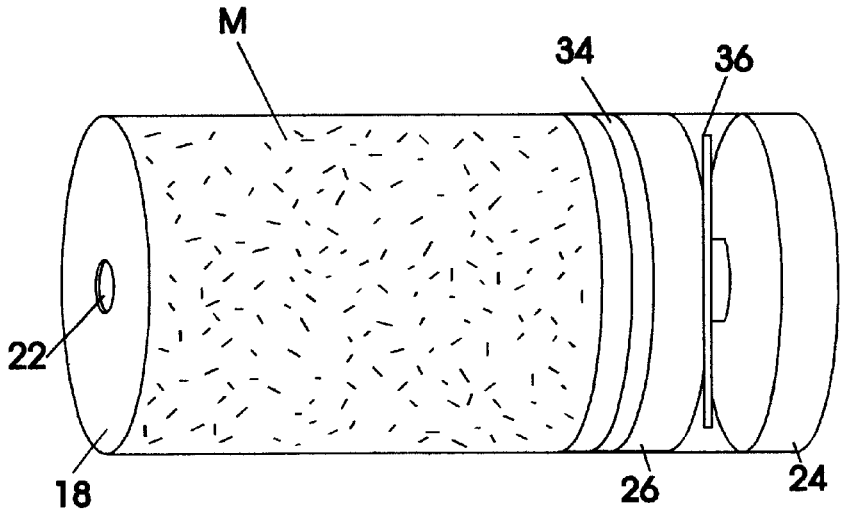
FIG. 4 is a cross-sectional view of illustrating the interior of the housing used in the first embodiment of the fire extinguisher system of the present invention.

FIGS. 1, 2*a,* 2*b,* 2*c,* 2*d,* 3 and 4 illustrate the housing of the present invention, and as seen, the housing 12 is a hollow structure that is designed and configured to maintain the dispersing media M (illustrated in FIG. 4). This hollow housing includes a first end 18 and a second end 20. Extending through the first end is an aperture 22, which can be threaded. This aperture acts as the exit and enables the housed media M to be dispersed via this opening. When assembling the unit, this aperture 22 acts as a means of enabling the media to be placed within the hollow housing.

Figure 11:
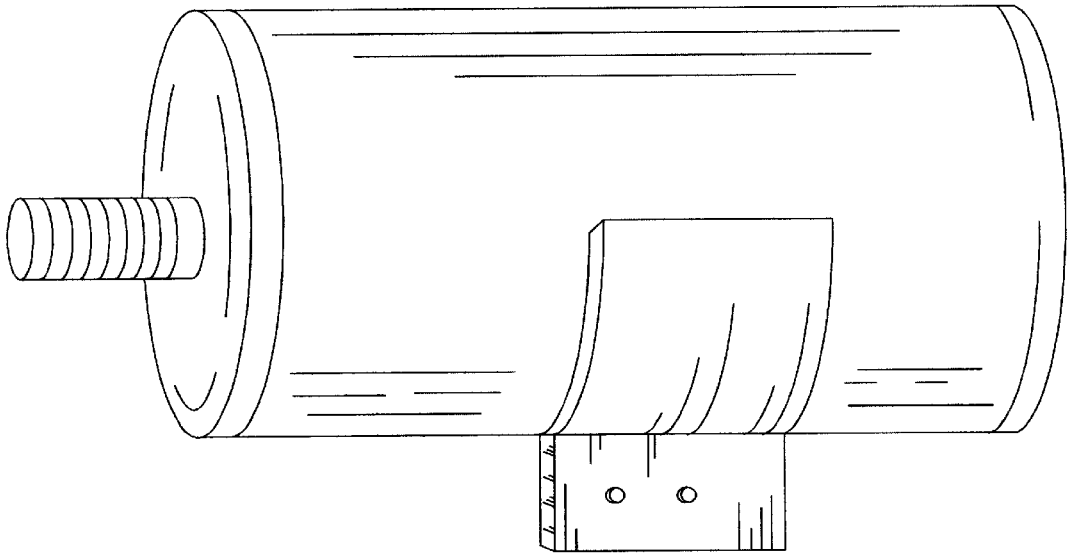
FIG. 11 is a perspective view of the housing used in the fire extinguisher system of the present invention, illustrating an example of an attaching device that can be used with the system of the present invention.

Coupled to this aperture 22 is the dissipation assembly 16 (see FIG. 1). This dissipation assembly will direct the housed media to the particular desired location. An exteriorly threaded rod (see FIG. 11, illustrated, but not labeled) can be secured to the aperture for aiding in receiving and securing the dissipation assembly 16. Located and secured to the second end 20 of the housing, as seen in FIGS. 1, 2*a,* 2*b,* 2*c,* 3, and 4 is an end plate 24.

In the first embodiment of the present invention, as seen in FIGS. 2*a,* 2*b,* 2*c,* 3, and 4 slideably located within the housing 12, is a plunger 26. This plunger 26 is located between the exit 22 and the endplate 24 and when the system is activated, will inherently move forward, towards the first end for aiding in the disbursement of the housed media M. This forward motion will increase the pressure for dispensing the media.

Figure 5:
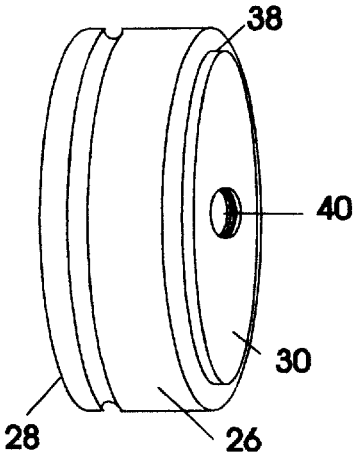
FIG. 5 is an enlarged perspective view of the plunger used in the fire extinguisher system of the present invention.

The plunger 26, as seen in FIGS. 2*a,* 2*b,* 2*c,* 3, 4 and 5 has a first end 28 and a second end 30. The first end 28 will receive the media while the second end will receive a mechanical device that will push the plunger 26 towards the exit 22 of the hollow housing. Since the first end will contact a fluid, an O-ring 34 can be located therein for preventing leaks or the like. As seen in FIG. 5, a groove (illustrated, but not labeled) can be circumferencially located on the plunger 26 for adequately receiving and maintaining the O-ring 34.

The mechanical movement device 32*a,* for the first embodiment of the present invention is generally a spring-loaded unit that is attached to the second end 30 of the plunger 26. As illustrated in FIG. 2*a,* this mechanical device comprises a spring 36 that is secured to the plunger 26. A recess, or as illustrated, a seat 38, is located in proximity to the second end of the plunger and this recess or seat 38 will receive and maintain the spring 36. Thus this will provide for the spring to be secured to the second end of the plunger.

Also located in the second end of the plunger, is a threaded opening 40 (see FIG. 5). This threaded opening 38 extends partially through the plunger and will receive a threaded shaft 42 that is used for cocking the mechanical device and enabling the spring to be in a compressed position. This threaded shaft is the tool that is used for adequately cocking the mechanical device in a storable position.

Figure 6:
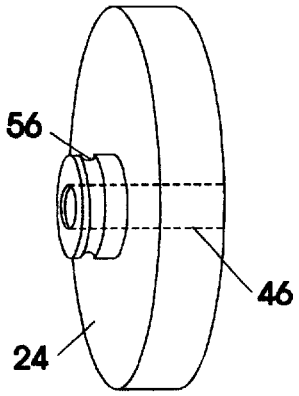
FIG. 6 is a perspective view of the end cap used in the fire extinguisher system of the present invention.

To place the mechanical movement device 32*a* in a useable position (spring is compressed, as seen in FIG. 4), the end cap 24 includes an opening 46, partially illustrated in outline, extending therethrough (see FIGS. 2*a* and 6). An elongated rod 42 (illustrated in FIG. 2*a* ) is the tool that is used to compress the spring. As seen, this elongated rod includes a first end 48 and a second end 50. The first end acts as a securing device while the second end of the tool acts as the handle. To use, the first end of the tool 42 is inserted through the opening 46 of the end cap 24. The first end 48 is secured to the opening 40 of the plunger 26. Once secured, the tool is pulled back, forcing the spring to be in a compressed state. This will provide for a void to exists between the second end of the plunger and the exit of the housing. Using the exit aperture, the extinguishing media is placed therein. Once filled, the fluid will force the spring 36 to remain in a compressed state. The dissipation assembly is secured to the exit for preventing the media to escape from the interior of the housing. The tool is removed from the plunger, and the unit is ready for installation.

In an alternative arrangement, an inlet can be located anywhere along the housing so as to provide for a separate inlet and a separate outlet. The inlet will allow for the media to be placed therein, while the media will escape via the outlet. Fusible material will be used to seal the cap to the outlet; however, fusible material will not be used for the inlets. The use of separate inlets and outlet will provide for a unit that will allow for a convenient and easy means of inserting the desired material into the hollow cylinder as well as provide a means of releasing the desired media when a fire is present.

It is noted that the spring is shown to decrease in size from the attachment from the plunger to the attachment at the end cap. This configuration is ideal for allowing the spring to compress easily and quickly. In addition, due to this configuration, as the media escapes the through the exit, this structure of the spring provides for a more forceful release, and thus, provides for a disbursement that is more forceful when compared to a spring without varying diameters. This conical shaped of the spring increases expansion rate when released, and thus provides for maximum velocity, and innately does not require gravity to dispense the housed media. As seen in FIG. 4, conical shape of the spring provides for the spring to be fully compressed.

Figure 7:
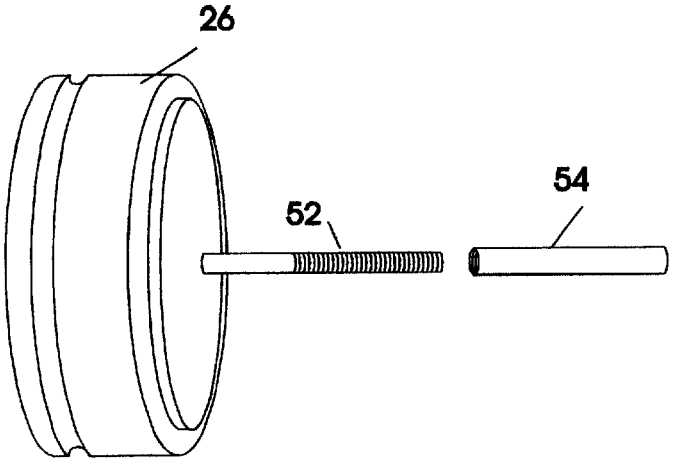
FIG. 7 is an alternative view of the plunger used in the fire extinguisher system of the present invention.

This arrangement of the tool can be altered in configuration, and an alternative arrangement is illustrated in FIG. 7. As seen in this figure, a threaded shaft 52 can be permanently secured to the plunger. A tool 54 being interiorly threaded can be inserted through opening 46 of the end cap 24 for receiving the shaft. Once secured, the user would proceed as discussed above. It is noted that the shaft can be an internally threaded hollow shaft, and the tool can be a threaded shaft, so as to provide for the final product to be a tool that is removably secured to the plunger via any commercially available removably attaching mechanism.

To provide for the mechanical device to be secured to both the plunger and end cap the end cap 24, like the plunger, includes a recess or seat 56 (illustrated in FIGS. 2*a* and 6). This seat will receive the second end of the spring, to provide for a more secure fit between the spring and end cap.

Figure 2B:
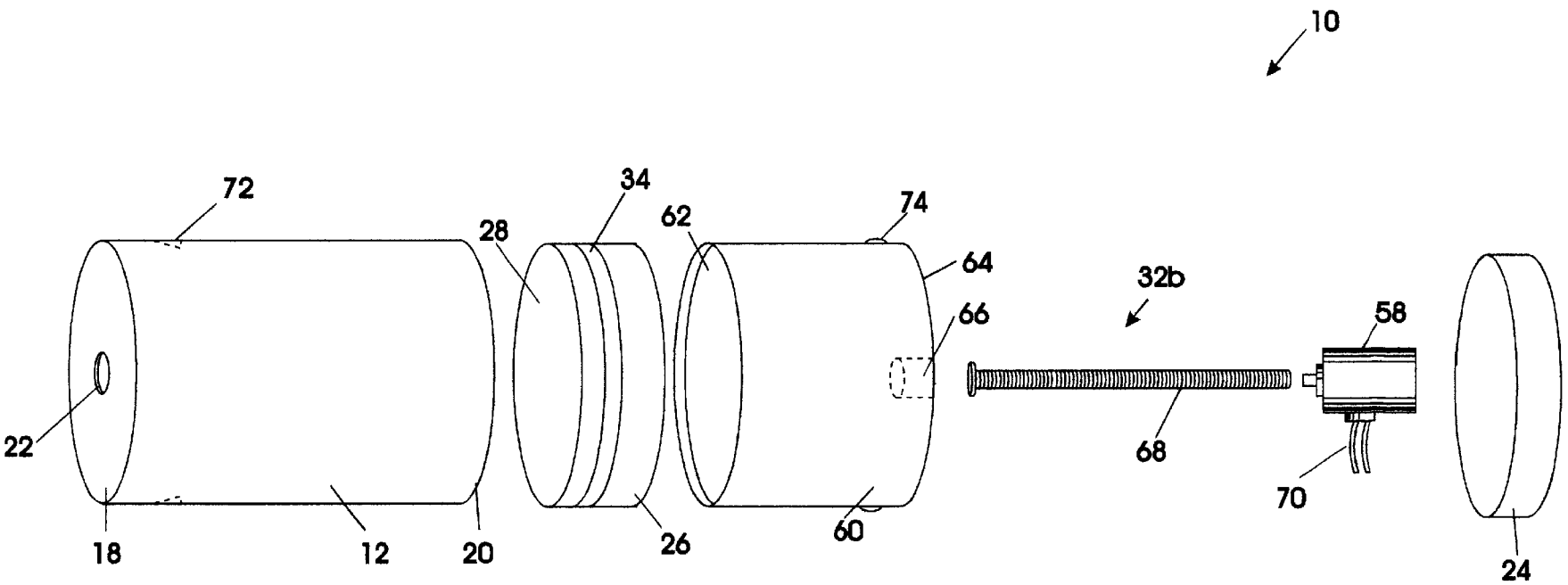
FIG. 2*b* is an exploded view of the components used in the fire extinguisher system of the present invention, illustrating an alternative embodiment of the mechanical movement device.

Alternatively, the mechanical movement device can be altered to provide for a device, which is mechanical, as well as electrical in nature. This altered configuration of the mechanical movement device is shown in FIG. 2*b*. As seen in this figure the mechanical movement device 32*b* is one that is controlled via a motor 58.

The housing 12, as seen in this altered configuration, is substantially the same shape and size as the housing illustrated in FIG. 2*a* and thus will not be described in further detail. The plunger 26, like the housing 12, includes substantially the same shape and configuration as the plunger illustrated in FIG. 2*a*. Secured to the second end 30 of this plunger 26 is the mechanical movement device 32*b*.

One of the components of the mechanical movement device 32*b* of this device is a circular hollow flange 60 secured to the second end of the plunger 26. This flange and plunger can be an integral unit. As seen, the flange includes an open end 62 and an enclosed end 64. Extending through the enclosed end is an internally threaded opening 66 that acts as a lead nut.

Secured to the end cap 24 is a motor 58. This motor can be a rotary reversible electric stepping motor. A rotary reversible electric stepping motor can be used, so that if this device is accidentally activated, then the unit can be refilled by merely enabling the motor to rotate in the opposite direction, so as to enable the interior of the housing to be filled.

The motor has a rotary output shaft connected to an axially extending lead screw 68. This lead screw 68 extends centrally through the second end of the flange and is in threaded engagement with the threaded opening 66. Thus, rotation of the lead screw 68 by the motor causes the flange to be moved axially along the length of the screw and thus cause the plunger to move forward. This will force the media out of the housing when a fire is present.

Powering the motor can be accomplished by way of conventional batteries or optionally using the existing wiring within a home. In this configuration cables, illustrated, but not labeled, can be coupled to a conventional power source. The cables may supply a reduce voltage DC from a remote transformer, or may alternatively supply AC current to a transformer located with the unit of the present invention. This will provide for a transformer to be secured in the end cap and electrically coupled to the motor. The motor may be of a conventional construction and is adapted to provide a predetermine number of control pulses to effect a precise number of revolutions of the lead screw. A limit switch may be operatively connected with the motor to deactivate the motor upon contact with radially inwardly extending projections 72 forced within the housing. Thus, upon activation, the motor will rotate. The rotation of the motor will cause the lead screw to rotate. This will provide for the plunger to extend axially upwards, until contact of the limit switch 74 with the actuation projection. Coupled to the motor is the activation means. This activation means is conventional and can be any conventional type of switch or the like.

Figure 2C:
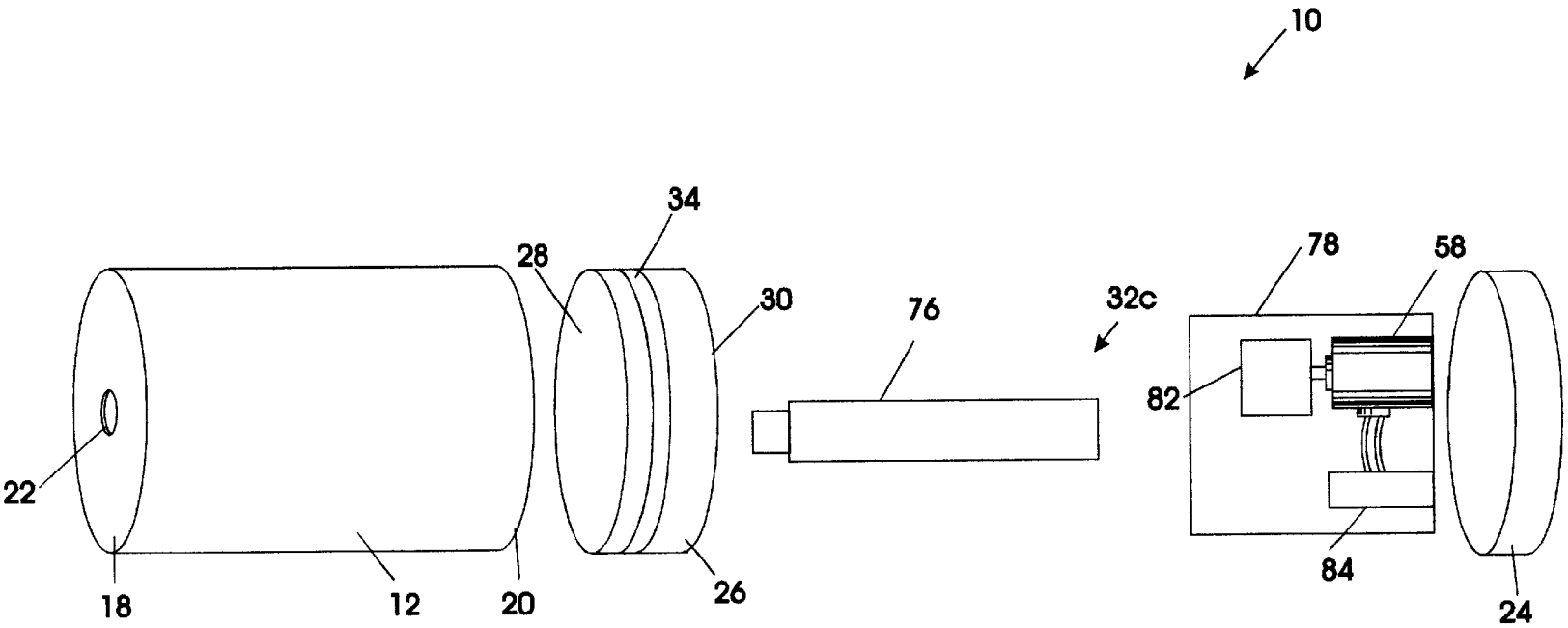
FIG. 2*c* is an exploded view of the components used in the fire extinguisher system of the present invention, illustrating a further embodiment of the mechanical movement device.
Figure 2D:
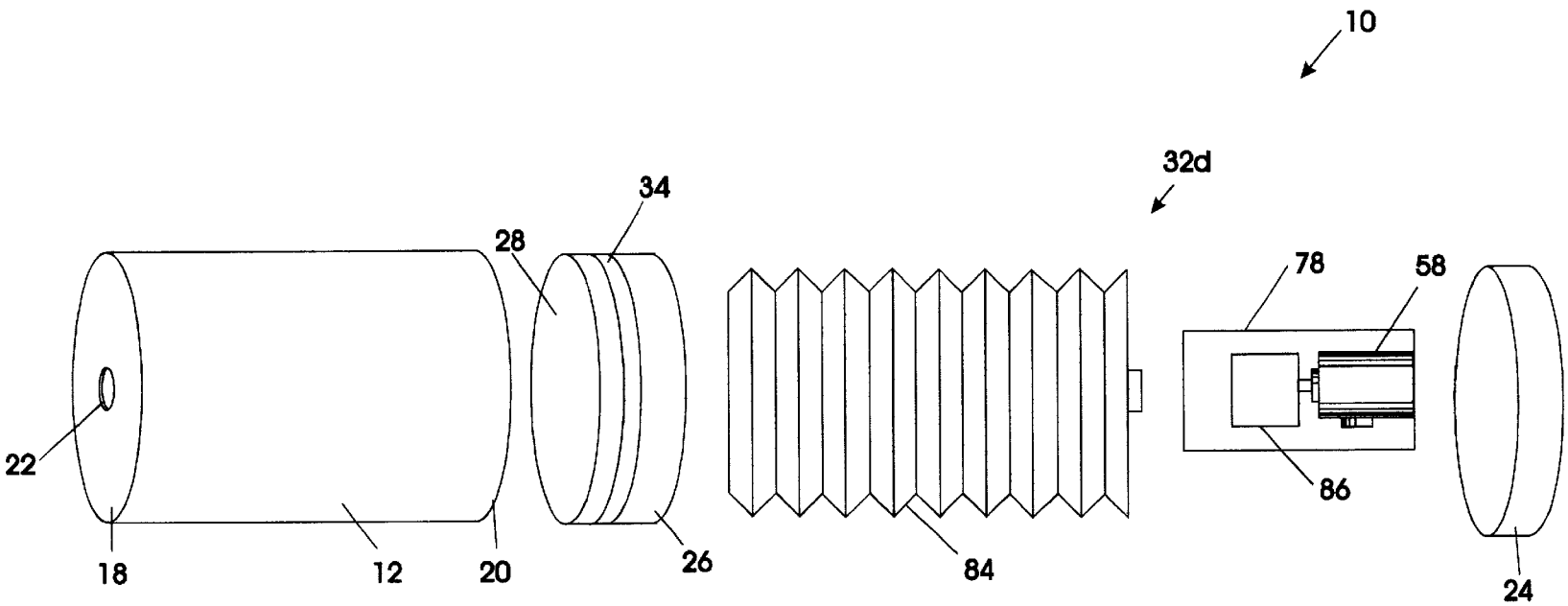
FIG. 2*d* is an exploded view of the components used in the fire extinguisher system of the present invention, illustrating a further embodiment of the mechanical movement device.
Figure 3:
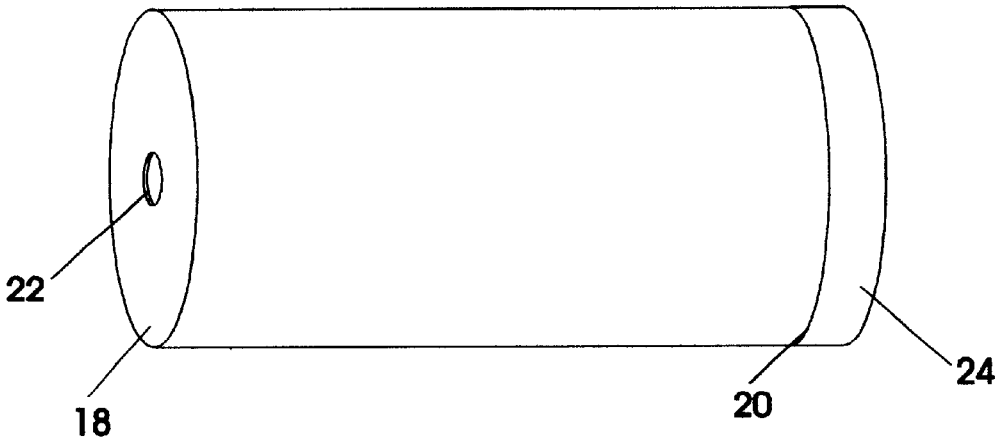
FIG. 3 is an exterior view of the housing used in the fire extinguisher system of the present invention.

Alternatively, the mechanical movement device can be altered to provide for a device, which is hydraulic, as well as electrical in nature. This altered configuration of the mechanical movement device is shown in FIG. 2*c*. As seen in this figure the mechanical movement device 32*c* is one that is controlled via a conventional hydraulic cylinder 76 and a motor 58.

The housing 12, as seen in this altered configuration, is substantially the same shape and size as the housing illustrated in FIG. 2*a* and thus will not be described in further detail. The plunger 26, like the housing 12, includes substantially the same shape and configuration as the plunger illustrated in FIG. 2*a*. Secured to the second end 30 of this plunger 26 is the mechanical movement device.

This mechanical movement device comprises a conventional hydraulic cylinder unit 76. This conventional hydraulic cylinder unit is secured to the second end 30 of the plunger, and when in a compress state, will provide for the inner cylinder to be located within the outer cylinder (as illustrated). When in an extended position the inner cylinder will extend outward from the outer cylinder. Thus, the inner cylinder is secured to the second end of the plunger and the outer cylinder is secured to the end cap. A control unit 78 is used for activating the hydraulic cylinder. The control unit 78 includes a motor 58 coupled to an electrical valve 80. The valve is coupled to a pump 82. Lines are used to couple the pump to the hydraulic cylinder unit. Thus when activated, the motor actives the pump and the valve to open. This will allow for the hydraulic fluid to flow within the cylinder and thus allow for adequate and efficient operation to occur. Coupled to the motor is the activation means. This activation means is conventional and can be any conventional type of switch or the like.

The mechanical movement device can further include an alternative configuration that will allow for the housed media to be dispensed by the use of a pneumatic bladder. This altered configuration is shown in FIG. 2*d*. As seen in this figure the housing 12, as seen in this altered configuration, is substantially the same shape and size as the housing illustrated in FIG. 2*a* and thus will not be described in further detail. The plunger 26, like the housing 12, includes substantially the same shape and configuration as the plunger illustrated in FIG. 2*a*. Secured to the second end 30 of this plunger 26 is the mechanical movement device.

The mechanical movement device 32*d* includes a collapsible bladder 84. The bladder is shown in FIG. 2*d* to be in an extended and outward position. The bladder includes a first end and a second end. The first end is coupled to the second end of the plunger while the second end is coupled to its control unit 78. The control unit includes a motor 58 coupled to a pneumatic pump 86. Thus in operation, the motor when activated, will cause the pump to activate. Upon activation, the pump will enable air to enter into the bladder. As air fills the bladder, it will force the plunger towards the exit. This will inherently cause the housed media to be forced out of the housing 12.

It is noted that the end plate 24 used in the embodiments shown in FIGS. 2*b,* 2*c,* and 2*d* will not include an opening nor will not include a seat. Thus, the end cap is merely a plate used to secure the electronically components utilized for the mechanical movement device shown in these figures.

Figure 8A:
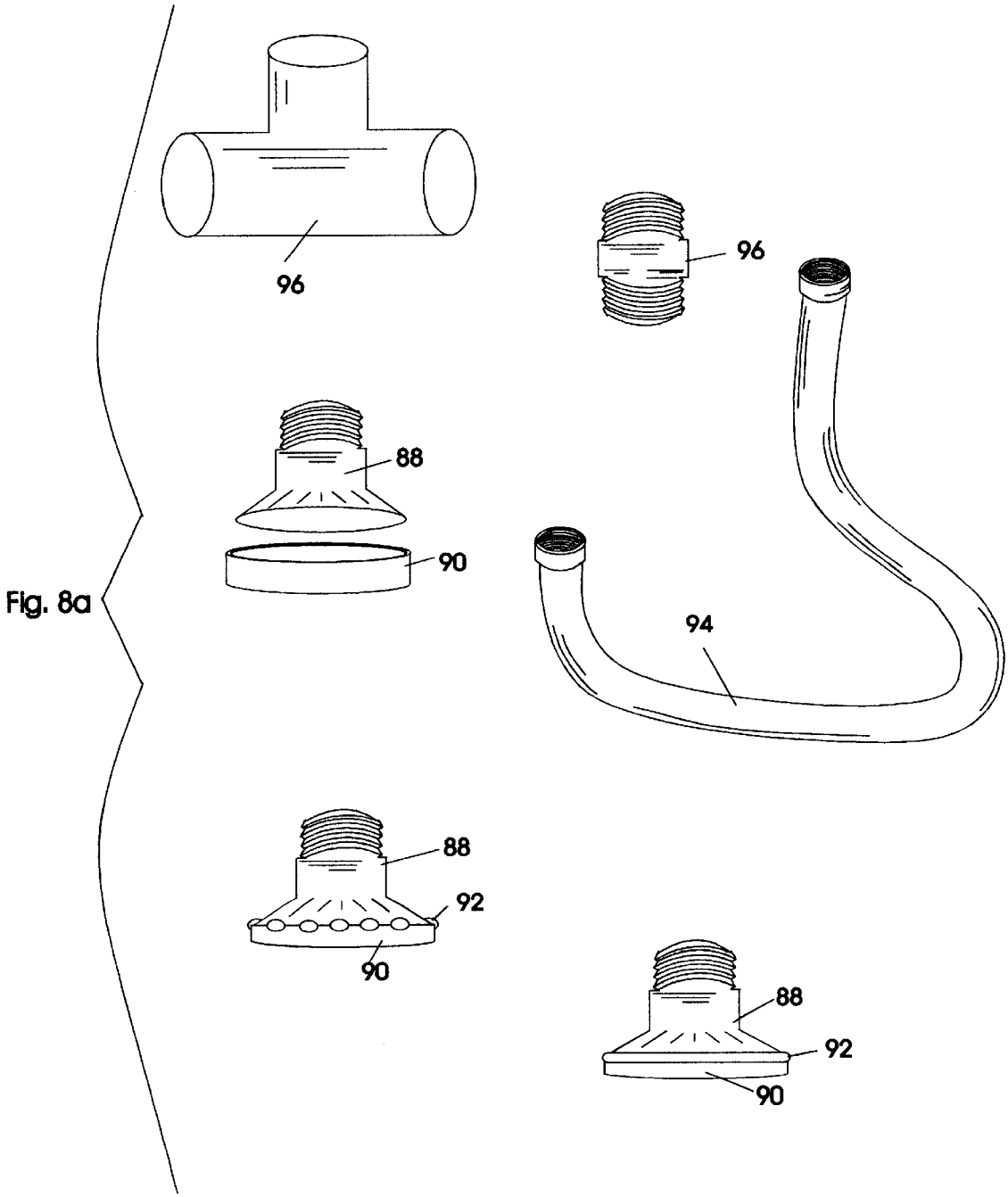
FIG. 8*a* is a side view illustrating the various components that can be used to form the dissipation assembly of the present invention.

The dissipation assembly can include any design and configuration for routing the fluid to the desired location. As seen in FIG. 1 and FIG. 8*a,* the tubing can be as complex as including several routes or can be as simple, as seen in FIG. 11, to include a mere tube with an end cap. The tubing 56 is conventional and is designed to be routed over the range and can include as many outlets as deemed necessary by the user. The outlets 88, used for the embodiment illustrated in FIG. 2*a,* include a unique feature in that the end caps 90 are secured to the outlets via fusible material 92. Thus, in the presence of fire, the fusible material will melt, causing the end cap to dislodge from the outlet, and enable the fluid to escape. As the fluid is escaping, pressure is released, and the spring forces the fluid out quickly and efficiently. The fusible material used to secure the end cap to the outlet is considered the released mechanism. Inherently, providing for an automatic means of releasing the housed media in the presence of fire. It is noted that since these elements, the tubing, nozzle, and end caps are conventional, they can include any structure for mating to each other. Accordingly, the tubing, nozzle, and end caps can be threadably secured, slideably secure or the like to provide for each element to be either internally/externally threaded or be adapted to slideably receive one of the elements for mating.

For designing the dissipating assembly, tubing 94 can be used and can be coupled to connectors 96, such as T-couplers, elbows, or the like. The tubing is made of fire retardant material and can be resilient, non-resilient, and any length or diameter. The connection between the tubing and connector can occur via any forms of conventional connecting or coupling means.

For the embodiment illustrated in FIG. 2*a,* the novel feature for this dissipating assembly is the use of end caps that are secured to the outlets via the fusible material. The configuration of the dissipation assembly is governed by the location of the housing and the desired placement of the outlet. The more places it is desired to include outlets, the more tubing and couplings are needed. For each outlet, there will be individual end caps secured via the fusible material. The housing, tubing, connectors, and nozzles will be fabricated from a material that is resistant to fire. Only the cap of the nozzle will be secured with fusible material. Thus providing a unit that will withstand fire and one that will output a material for extinguishing a fire when present.

Thus, it is seen that installation of the unit can occur easily and efficient. The installation will be located along the undersurface of the hood, and will not take up any valuable cabinet space. The housing, couplings, tubing and nozzles are secured to the undersurface of the hood via conventional attaching elements.

Figure 8B:
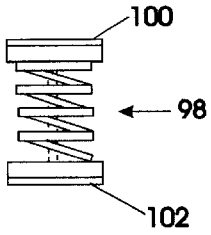
FIG. 8*b* is a side view of an alternative embodiment of a plug that can be used with the system of the present invention.

Alternatively, a plug can be located within the end cap. This plug is illustrated in FIG. 8*b.* As seen in this figure this plug 98 includes a top area, a bottom area and a center portion located therebetween. The top area will be in communication with the housed media and thus includes an O-ring 100. The bottom portion adheres the plug to the interior of the outlet. To adhere to the interior of the outlet, a fusible material 102, such as solder is used. Accordingly, the plug is secured to the interior via the fusible material. When a fire is present, the fusible material will melt, causing the plug 98 to fall therefrom and thus allow for the housed media to escape and extinguish the fire.

A spring 104 can be located between the top and bottom portion. In this arrangement, the spring will be compressed when secured internally. Once a fire is detected, the spring will expand, as shown in FIG. 8*b,* and cause the plug to be released quickly, so as to allow for the housed media to be released efficiently.

Figure 9:
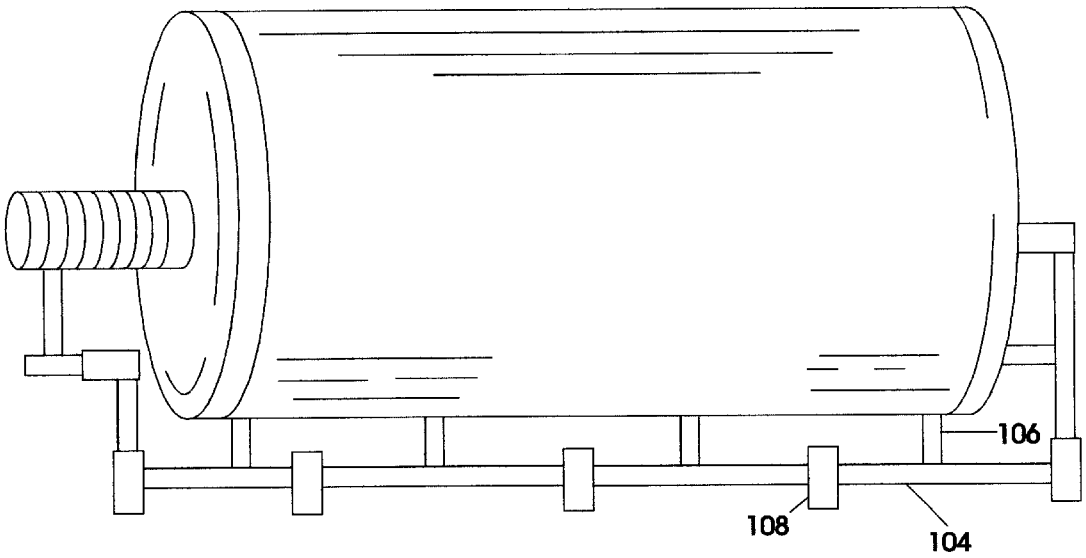
FIG. 9 is a perspective view of an alternative configuration for the fire extinguisher system of the present invention.

For the embodiments illustrated in FIGS. 2*a*–2*d,* triggering the mechanical device can be accomplished by providing the fusible material to located in proximity to the exterior of the housing and dissipating assembly as seen in FIG. 9. In this arrangement, as shown, cable 104 is secured to the mechanical movement device. As shown, this cable runs along the side the exterior of the housing and along the length of the dissipating assembly. Guides 106 are used to aid in its securement to the assembly. Strategically placed along the path of the cable are fusible links 108. In this arrangement, when a fire is present, the links will melt, thus providing for a break to occur within the path of the cable and innately providing for the mechanical movement device to be activated.

For the embodiment illustrated in FIG. 2*a,* the cable would be used to maintain the spring in the compressed state. Once the fusible link breaks the cable, the spring is released from its compressible state and forces the housed media out. This will force the end, if not already released, out of the outlet and enable the housed media to extinguish the fire.

Figure 10:
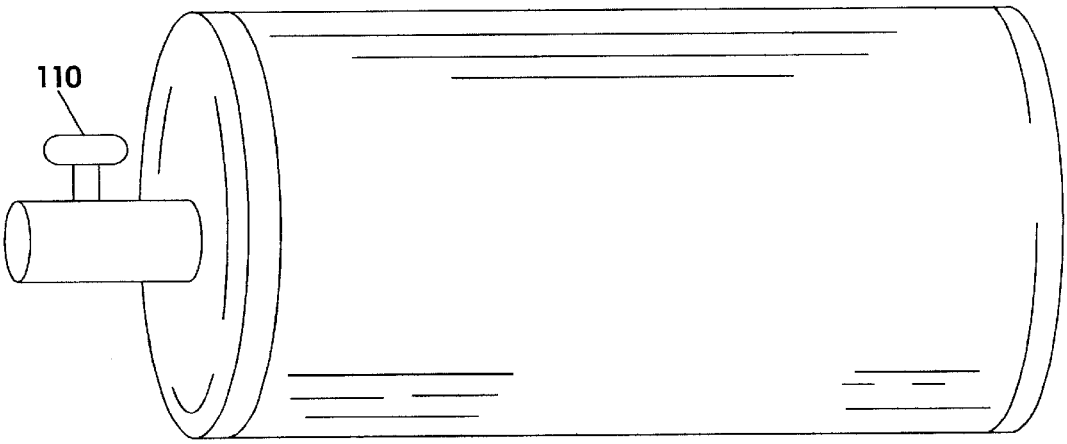
FIG. 10 is a perspective view of an alternative configuration for the fire extinguisher system of the present invention utilizing a manual means of operation.

For the embodiment illustrated in FIGS. 2*b,* 2*c* and 2*c,* the cable can be coupled to a conventional switch, which is coupled to the motor. A break in the cable will cause the switch to activate the motor and thus activate the mechanical movement device. Operation continues as described above To enhance the product further, as seen in FIG. 10, a manual shut off valve 110 can be locate at the exit, along the path of the dissipation assembly, or at the outlet of the dissipation assembly. This valve will provide a mechanical means of enabling fluid to escape from the interior of the housing. The interior of the housing, in this embodiment, can have substantially the same shape and design of the interior as designed for the embodiments illustrated in FIGS. 2*a* and 9. Optionally, the spring and plunger assembly can be eliminated for providing a more simplified design. The use of a valve will provide for a manual release mechanism. It is noted that this valve can be used in combination with the automatic release mechanism, to enable the user to quickly extinguish a fire without waiting for the fusible material to melt.

For attaching the unit (housing, tubing, and couplings) to the desired surface, any conventional attaching means can be utilized, as seen in FIG. 11. For example, and as illustrated, conventional brackets can be used, magnets, or the like. This will offer the user any type of means necessary for adequately attaching the unit to the desired surface.

Other features can be added to any of the embodiments above for enhancing the final product. For example, an audible alarm can be coupled to the unit, so that as the fusible material melts, a switch will be activated for activating an audible alarm. This will alert the user of the danger. Another feature that can be added to the unit is a heat shield. This heat shield will be secured to the lower surface of the housing and will deflect the flames from the potential fire. This shield and/or housing can be insulated so as to provide for added protection of the unit when installed. Other devices, such as devices to shut off power and/or devices to alert fire department and/or other emergency personnel can be coupled to the unit of the present invention.

It is noted the mechanical movement device can be used in combination with conventional hand held fire extinguisher. This will provide a unit that will not need to be service as well as provide a unit that will operate adequately and efficiently. For enable such a unit, the conventional handle of the conventional fire extinguisher would be coupled to the mechanical movement device of the present invention. This will provide for the mechanical movement device to operate once the conventional fire extinguisher handle is depressed. Thus the conventional handle would be coupled to a switch via conventional means. Once the handle is activated switch would activate the mechanical movement device by way of either releasing the spring or optionally activating the motor.

While the invention has been particularly shown and described with reference to an embodiment thereof, it will be understood by those skilled in the art that various changes in form and detail may be made without departing from the spirit and scope of the invention.

We claim:

1. A fire extinguisher unit comprising:

a hollow housing having a first end and a second end; said first end includes an outlet;

a fire extinguishing media is stored in said hollow housing;

a mechanical movement device is located within said housing;

a plunger is located within said housing and said plunger is located between said media and said mechanical movement device and is exteriorly coupled to said mechanical movement device;

an activation device is located in proximity to said hollow housing for detecting a fire;

said media, when stored, forces said mechanical movement device to be a cocked and storable position;

said activation device enable said mechanical movement device to move when fire is detected and when fire is detected said mechanical movement device is un-cocked and released;

said mechanical movement device forces said plunger towards said exit when a fire is detected and forces the housed media out of said housing; and said mechanical movement device moves at a constant rate and provides for said media to travel at a constant velocity, constant pressure and flow rate.

2. A fire extinguisher unit as in claim 1 wherein a dissipating assembly is secured to said outlet for guiding said housed media once a fire is detected and said mechanical movement device is activated.

3. A fire extinguisher unit as in claim 1 wherein said mechanical movement device is a conically shaped spring.

4. A fire extinguisher unit as in claim 1 wherein said mechanical movement device is a hydraulically controlled mechanism.

5. A fire extinguisher unit as in claim 1 wherein said mechanical movement device is controlled via a motor assembly.

6. A fire extinguisher unit as in claim 1 wherein said mechanical movement device includes a pneumatic assembly for forcing the plunger towards said exit.

7. A fire extinguisher unit as in claim 1 wherein an end cap is secured to said outlet and said end cap is secured via a fusible material, said fusible material will melt when a fire is present for extinguishing a fire, and said fusible material constitutes said activation device.

8. A fire extinguisher unit as in claim 2 wherein a dissipating assembly including at least one nozzle outlet is secured to said outlet, a cap is secured via fusible material to said at least one nozzle outlet, said fusible material will melt when a fire is present for enabling said mechanical movement device to activate and force said housed media out of said housing for extinguishing a fire.

9. A fire extinguisher unit as in claim 1 wherein said plunger includes a seal for preventing said housed media from escaping.

10. A fire extinguisher unit as in claim 1 wherein said housing includes attaching device for enabling attachment to any desired surface.

11. A fire extinguisher unit as in claim 10 wherein said attaching device are magnets.

12. A fire extinguisher unit as in claim 1 wherein a conventional valve is secured to said outlet for enabling operation to occur automatically by the use of said activation device or manually via said valve.

13. A fire extinguisher unit as in claim 1 wherein a cable is coupled to said housing and to said mechanical movement device, a plurality of fusible links are secured to said cable, and upon the presence of a fire at least one fusible link will dissolve and will cause said mechanical movement device to activate and force said housed media out via said outlet and extinguish said fire.

14. A fire extinguisher as in claim 1 wherein said outlet is horizontally aligned with a center of said plunger.

15. A fire extinguishing unit for use above a range, said fire extinguishing unit comprising:

a hollow housing having a first end and a second end;

an attaching device for attaching said hollow housing to an existing hood located over a conventional range; said first end includes an outlet;

a fire extinguishing media is stored in said hollow housing;

a mechanical movement device is located within said housing;

a plunger is located within said housing and said plunger is located between said media and said mechanical movement device and is exteriorly coupled to said mechanical movement device;

an activation device is located in proximity to said hollow housing for detecting a fire;

said media, when stored, forces said mechanical movement device to be a cocked and storable position;

said activation device enable said mechanical movement device to move when fire is detected and when fire is detected said mechanical movement device is un-cocked and released;

said mechanical movement device forces said plunger towards said exit when a fire is detected and forces the housed media out of said housing; said mechanical movement device moves at a constant rate and provides for said media to travel at a constant velocity, constant pressure and flow rate; and a dissipating assembly is coupled to said outlet and includes at least one nozzle strategically located above at least one burner of said range.

16. A fire extinguisher unit as in claim 15 wherein said mechanical movement device is a conically shaped spring.

17. A fire extinguisher unit as in claim 15 wherein a cap is secured via fusible material to said at least one nozzle outlet, said fusible material will melt when a fire is present for enabling said mechanical movement device to activate and force said housed media out of said housing for extinguishing a fire.

18. A fire extinguisher unit as in claim 15 wherein a cable is coupled to said housing, along said dissipating assembly and to said mechanical movement device, a plurality of fusible links are secured to said cable, and upon the presence of a fire at least one fusible link will dissolve and will cause said mechanical movement device to activate and force said housed media out via said outlet and extinguish said fire.

19. A fire extinguisher as in claim 15 wherein said outlet is horizontally aligned with a center of said plunger.

* * * * *